US008960833B2

(12) United States Patent
Satou et al.

(10) Patent No.: US 8,960,833 B2
(45) Date of Patent: Feb. 24, 2015

(54) INK JET RECORDING DEVICE AND METHOD OF DRIVING INK JET RECORDING HEAD

(71) Applicants: Takashi Satou, Kanagawa (JP); Shuusuke Iwata, Kanagawa (JP)

(72) Inventors: Takashi Satou, Kanagawa (JP); Shuusuke Iwata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/943,961

(22) Filed: Jul. 17, 2013

(65) Prior Publication Data

US 2014/0022294 A1 Jan. 23, 2014

(30) Foreign Application Priority Data

Jul. 18, 2012 (JP) ..... 2012-159322

(51) Int. Cl.
*B41J 29/38* (2006.01)
*B41J 2/045* (2006.01)

(52) U.S. Cl.
CPC ..... *B41J 2/04588* (2013.01); *B41J 2/04596* (2013.01); *B41J 2/04598* (2013.01); *B41J 2/04581* (2013.01); *B41J 2/04516* (2013.01); *B41J 2/04551* (2013.01); *B41J 2/04593* (2013.01)
USPC ..... 347/11

(58) Field of Classification Search
CPC ..... B41J 2/04593; B41J 2/04596; B41J 2/04598; B41J 2/04581; B41J 2/04588
See application file for complete search history.

(56) References Cited

U.S. PATENT DOCUMENTS

| | | | | |
|---|---|---|---|---|
| 7,258,408 | B2 * | 8/2007 | Usuda | 347/11 |
| 7,628,463 | B2 | 12/2009 | Sasaki | |
| 2011/0279502 | A1 * | 11/2011 | Kaneko et al. | 347/11 |

FOREIGN PATENT DOCUMENTS

| | | |
|---|---|---|
| JP | 2004-017630 | 1/2004 |
| JP | 2007-182061 | 7/2007 |

* cited by examiner

*Primary Examiner* — Julian Huffman
(74) *Attorney, Agent, or Firm* — Oblon, Spivak, McClelland, Maier & Neustadt, L.L.P.

(57) ABSTRACT

An ink jet recording device includes an ink jet recording head including a pressure chamber communicating with an ink ejection orifice, and a piezoelectric actuator pressurizing ink in the pressure chamber. A drive signal generating unit generates a drive waveform having multiple drive pulses. A pulse supplying unit selects one or more of the drive pulses from the drive waveform depending on a size of an ink drop to be ejected and supplies the selected drive pulses to the piezoelectric actuator. The drive pulses in the drive waveform include ejection pulses to eject the ink drop from the orifice and a non-ejection pulse to suppress residual oscillations of the ink. The pulse supplying unit is configured to select one or more of the ejection pulses and the non-ejection pulse when an ink drop having a maximum size is to be ejected.

3 Claims, 13 Drawing Sheets

INK JET RECORDING DEVICE AND METHOD OF DRIVING INK JET RECORDING HEAD

BACKGROUND OF THE INVENTION

1. Field of the Invention

The present invention relates to an ink jet recording device including an ink jet recording head in which a pressure chamber communicating with an ink ejection orifice is formed and a piezoelectric actuator is driven to change the pressure of ink in the pressure chamber, and a method of driving the ink jet recording head.

2. Description of the Related Art

Conventionally, an ink jet recording device carrying an ink jet recording head is known. The known ink jet recording head is a liquid drop ejection head including a nozzle that ejects an ink drop, a liquid passage that communicates with the nozzle, and a pressure generating element that pressurizes ink in the liquid passage. A piezoelectric ink jet recording head using a piezoelectric device as the pressure generating element is also known. In this ink jet recording head, a drive pulse is supplied to the piezoelectric device and the piezoelectric device is driven to pressurize the ink in the liquid passage, so that an ink drop is ejected from the nozzle of the ink jet recording head.

In the piezoelectric ink jet recording head, some contrivance to stabilize the ejection of ink drops has been put for the purposes of maintenance of quality of images and others.

For example, Japanese Laid-Open Patent Publication No. 2004-017630 discloses an ink jet recording head in which a drive signal including multiple pulses is used so that the ink meniscus oscillations by a following pulse resonate with the ink meniscus oscillations by a preceding pulse and the ink drops ejected by these pulses are combined together during ejection.

In the ink jet recording head of Japanese Laid-Open Patent Publication No. 2004-017630, the impact positions of different ink drops are set to the same position by the use of the drive signal including the multiple pulses.

However, in the ink jet recording head of Japanese Laid-Open Patent Publication No. 2004-017630, if the number of pulses in the drive signal increases, the drive force to draw the meniscus increases excessively, the stability of ink drop ejection worsens, which results in an increase in the occurrence of misaligned ejection.

SUMMARY OF THE INVENTION

In one aspect, the present invention provides an ink jet recording device, and a method of driving an ink jet recording head which are capable of maintaining the stability of ink drop ejection without increasing the occurrence of misaligned ejection.

In an embodiment which solves or reduces one or more of the above-mentioned problems, the present invention provides an ink jet recording device including: an ink jet recording head including a pressure chamber that communicates with an ink ejection orifice, and a piezoelectric actuator that changes a pressure of ink in the pressure chamber; a drive signal generating unit that generates a drive waveform having multiple drive pulses; and a pulse supplying unit that selects one or more of the drive pulses from the drive waveform depending on a size of an ink drop to be ejected from the ink ejection orifice and supplies the selected drive pulses to the piezoelectric actuator, wherein the multiple drive pulses in the drive waveform comprise a plurality of ejection pulses to eject the ink drop from the ink ejection orifice and a non-ejection pulse to suppress residual oscillations of the ink following the ejection pulses, and the pulse supplying unit is configured to select one or more of the plurality of ejection pulses and the non-ejection pulse from the drive waveform when an ink drop having a maximum size is to be ejected from the ink ejection orifice.

Other objects, features and advantages of the present invention will become more apparent from the following detailed description when read in conjunction with the accompanying drawings.

DETAILED DESCRIPTION OF THE PREFERRED EMBODIMENTS

A description will be given of embodiments of the present invention with reference to the accompanying drawings.

Figure 1:
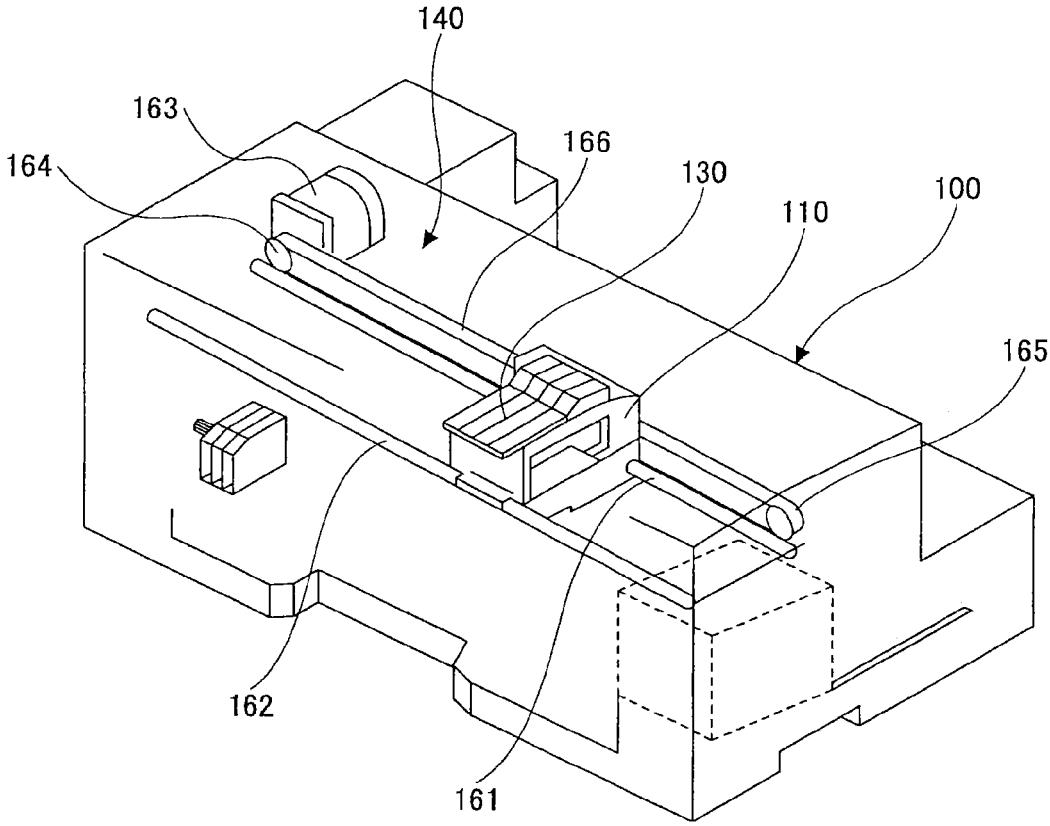
FIG. 1 is a diagram showing the outline composition of an ink jet recording device of an embodiment of the invention.
Figure 2:
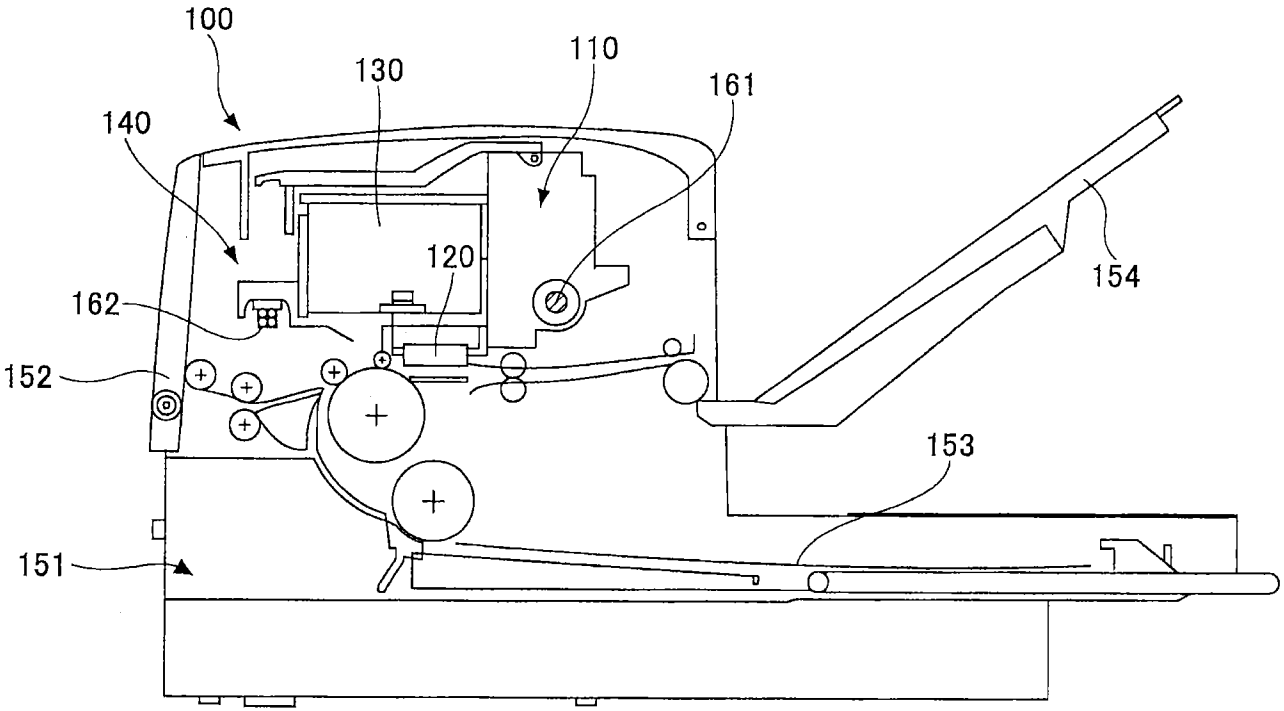
FIG. 2 is a diagram showing the outline composition of the ink jet recording device of the present embodiment.

FIG. 1 is a diagram showing the outline composition of an ink jet recording device of an embodiment of the invention. FIG. 2 is a diagram showing the outline composition of the ink jet recording device of the present embodiment.

As shown in FIGS. 1 and 2, the ink jet recording device 100 of the present embodiment includes a printing mechanism part 140 which is internally arranged to include a carriage 110, an ink jet recording head 120, and an ink cartridge 130. The carriage 110 is arranged to be movable in a main scanning direction of the ink jet recording device 100. For the sake of convenience, in the following, the ink jet recording head 120 will be called the recording head 120.

In the ink jet recording device 100 of the present embodiment, a sheet 153 is fed from a sheet cassette 151 or a manual bypass tray 152 to the printing mechanism part 140, a desired image is printed on the sheet 153 by the printing mechanism part 140, and the sheet 153 is delivered to a sheet output tray 154 which is attached to the rear side surface of the ink jet recording device 100.

The carriage 110 in the printing mechanism part 140 is held on a main guide rod 161 and a sub-guide rod 162 so that the carriage 110 is movable in the main scanning direction which is perpendicular to the paper of FIG. 2. The main guide rod 161 and the sub-guide rod 162 are a pair of guide members which are arranged horizontally and mounted on right and left side plates (which are not illustrated) of the ink jet recording device 100.

The recording head 120 is arranged to eject ink drops of respective colors of yellow (Y), cyan (C), magenta (M) and black (Bk). The recording head 120 is arranged on the carriage 110 in the present embodiment such that the ink drop ejection surface of the recording head 120 faces downward. The ink cartridge 130 is disposed on the top of the carriage 110 such that the ink cartridge 130 is exchangeable for a new cartridge. The ink cartridge 130 supplies the inks of the respective colors to the recording head 120.

The carriage 110 is arranged so that the rear side of the carriage 110 (its downstream side in a sheet transporting direction) is fitted to a main guide rod 161 in a slidable manner and the front side of the carriage 110 (its upstream side in the sheet transporting direction) is fitted to a sub-guide rod 162 in a slidable manner. The carriage 110 is fixed by a timing belt 166 which is wound between a drive pulley 164 and a driven pulley 165 and rotated by a scanning motor 163. By the forward and backward rotation of the scanning motor 163, the carriage 110 is moved forward and backward in the main scanning direction.

In the present embodiment, the multiple color recording head 120 is used. Alternatively, a single-color recording having a nozzle for ejecting ink drops of a single color may be used. As will be explained below, the recording head 120 in the present embodiment may be a piezoelectric ink jet recording head in which a diaphragm is provided to form a part of walls of a liquid passage and the diaphragm is deformed by using a piezoelectric device.

Figure 3:
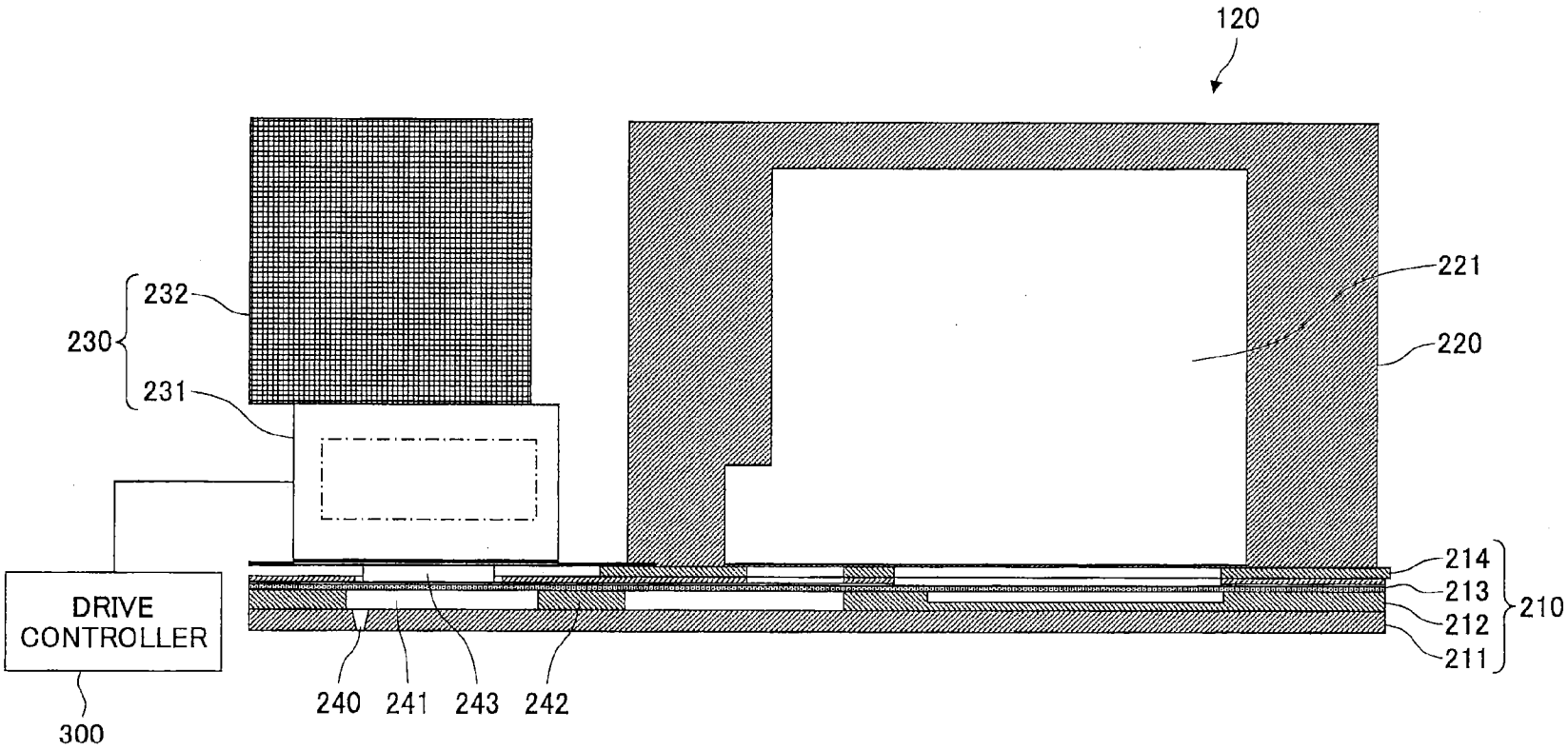
FIG. 3 is a diagram showing an ink jet recording head in the ink jet recording device of the present embodiment.

FIG. 3 is a diagram showing the recording head in the ink jet recording device of the present embodiment.

As shown in FIG. 3, the recording head 120 in the present embodiment generally includes a liquid passage board 210, a frame 220, and a pressure generating part 230.

The liquid passage board 210 includes a nozzle plate 211, a restrictor plate 212, a diaphragm plate 213, and a manifold plate 214. The nozzle plate 211 includes multiple ink ejection orifices 240 which are arrayed in a direction perpendicular to the paper of FIG. 3. The restrictor plate 212 includes pressure chambers 241 and a flow-resistance part 242. The pressure chambers 241 in the restrictor plate 212 communicate with the ink ejection orifices 240 in the nozzle plate 211, respectively. The flow-resistance part 242 controls the amount of ink liquid entering the pressure chambers 241. The diaphragm plate 213 is formed with a diaphragm 243 for efficiently transmitting the pressure generated by the pressure generating part 230 to the pressure chambers 241. The manifold plate 214 serves to distribute the ink in a common ink chamber 221 to each of the ink ejection orifices 240.

The frame 220 holds the liquid passage board 210, and includes the common ink chamber 221 which stores the ink supplied from the outside, and the opening of the common ink chamber 221 faces the manifold plate 214.

In the pressure generating part 230, one end of each of piezoelectric actuators 231 is secured to a support member 232, and the other end of each piezoelectric actuator 231 is bonded to the diaphragm plate 213 by an adhesive. In each piezoelectric actuator 231, conductive material layers and a piezoelectric material layer are laminated together. The piezoelectric actuators 231 in the present embodiment are formed with electrodes and electrically connected to a drive controller 300 via the electrodes and connecting wires. The ink is supplied from an ink supply pipe or head connecting pipe (which is not illustrated) to the common ink chamber 221. The ink in the common ink chamber 221 passes through the manifold plate 214 and is supplied sequentially to the flow-resistance part 242, the pressure chambers 241, and the ink ejection orifices 240 in this order.

The drive controller 300 causes the piezoelectric actuators 231 to expand and contract by supplying controlled drive pulses to the piezoelectric actuators 231. If the supplying of the drive pulses is stopped, each piezoelectric actuator 231 returns back to its original state before the expansion and contraction. In the present embodiment, pressure is momentarily exerted on the ink in the pressure chambers 221 according to the deformation of the piezoelectric actuators 231, and ink drops are ejected from the ink ejection orifices 240 to the surface of a recording medium.

It has been found that the recording head 120 as in the above-described embodiment has a Helmholtz resonant period which is also called a Helmholtz period. This Helmholtz period is specific to the recording head 120 and may be defined by the compliances and the inertances which are represented by the configurations of the ink ejection orifices 240, the pressure chambers 241 and the flow-resistance part 242, and the ink in the pressure chambers 241. See Japanese Laid-Open Patent Publication No. 2004-017630.

Next, the drive controller 300 in the ink jet recording device of the present embodiment will be described with reference to FIG. 4.

Figure 4:
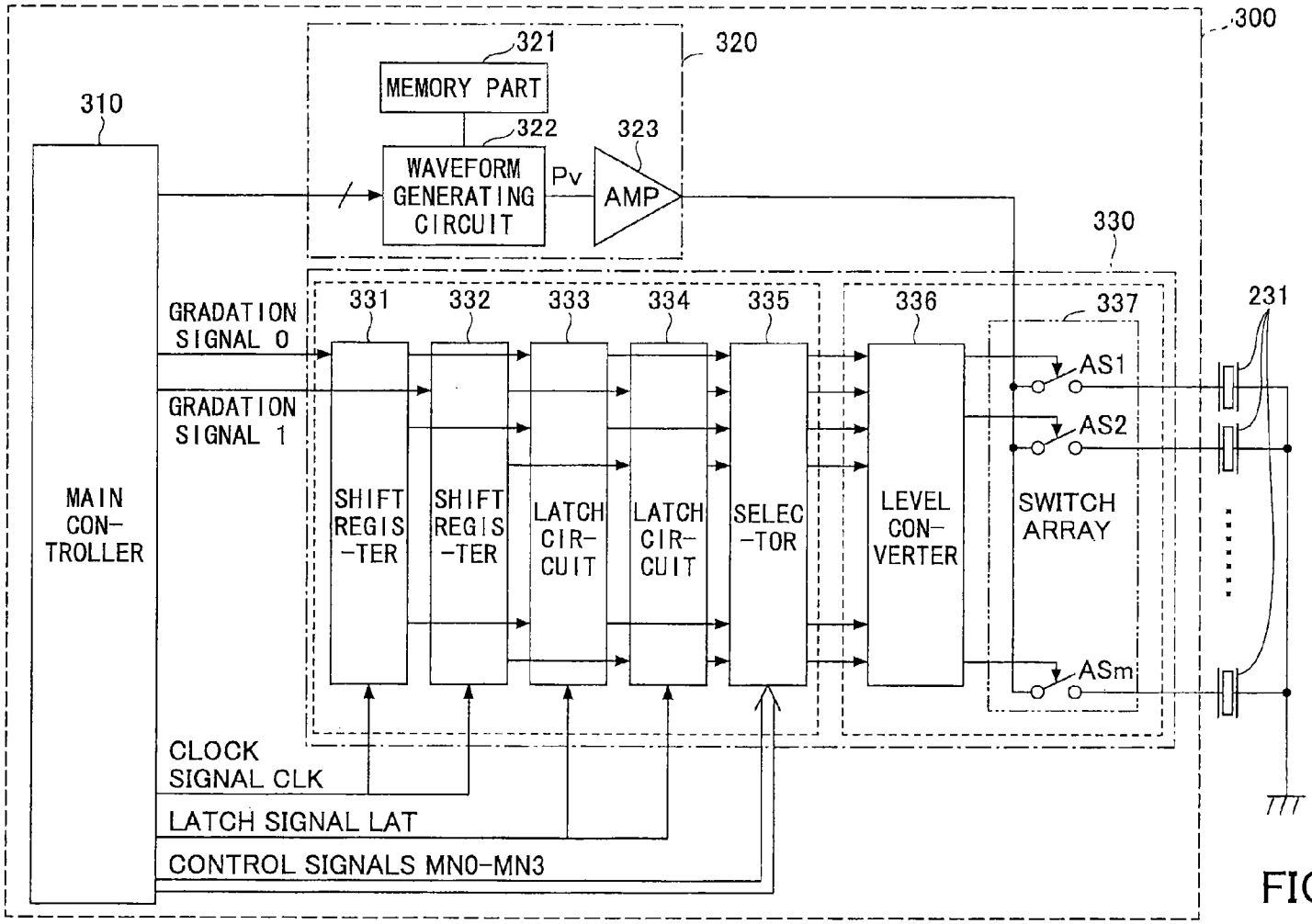
FIG. 4 is a block diagram showing the composition of a drive controller in the ink jet recording device of the present embodiment.

FIG. 4 is a diagram showing the composition of the drive controller 300 in the ink jet recording device of the present embodiment.

The drive controller 300 generally includes a main controller 310, a drive signal generating circuit 320, and a head driver circuit 330.

The main controller 310 generates signals for operating the recording head 120, based on, for example, image data input to the ink jet recording device 100 of the present embodiment, so that the recording head 120 is operated to eject ink drops according to the generated signals. The drive signal generating circuit 320 generates a drive waveform to drive the recording head 120. The head driver circuit 330 drives the piezoelectric actuators 231 by supplying the drive waveform generated by the drive signal generating circuit 320 to the piezoelectric actuators 231.

The drive waveform generating circuit 320 includes a memory part 321, a waveform generating circuit 322 and an amplifier (AMP) 323. In the memory part 321, pattern data of a drive waveform (drive signal) Pv is stored. The waveform generating circuit 322 includes a DA converter which performs digital-to-analog (DA) conversion of the data of the drive waveform read from the memory part 321.

The head driver circuit 330 includes shift registers 331 and 332, latch circuits 333 and 334, a selector 335, a level converter 336 and a switch array 337.

A gradation signal 0 and a clock signal CLK from the main controller 310 are input to the shift register 331. A gradation signal 1 and a clock signal CLK from the main controller 310 are input to the shift register 332.

The latch circuit 333 latches a registration value of the shift register 331 in response to receiving a latch signal LAT from the main controller 310. The latch circuit 334 latches a registration value of the shift register 332 in response to receiving a latch signal LAT from the main controller 310.

The selector 335 selects one of control signals MN0-MN3 from the main controller 310, based on the output value of the latch circuit 334 and the output value of the latch circuit 335, and outputs the selected control signal to the level converter 336. The level converter 336 performs the level conversion of the output value of the selector 335. The switch array 337 is an array of analog switches AS1 to ASm, and ON/OFF states of the analog switches AS1 to ASm are controlled by the output signals of the level converter 336.

The drive waveform Pv from the drive signal generating circuit 320 is input to the switches AS1 to ASm in the switch array 337, and the switches AS1 to ASm are connected to the piezoelectric actuators 231 corresponding to the ink ejection orifices 240 of the recording head 120, respectively.

The drive waveform (drive signal) Pv from the drive signal generating circuit 320 is supplied to the input terminals of the switch array 337, and the piezoelectric actuators 231 of the pressure generating part 230 are connected to the output terminals of the switch array 337. Hence, for example, during a period for which the print data supplied to the switch array 337 indicates "1", drive pulses obtained from the drive waveform Pv are supplied to the piezoelectric actuators 231, and the piezoelectric actuators 231 expand and contract according to the drive pulses. On the other hand, during a period for which the print data supplied to the switch array 337 indicates "0", the supplying of the drive pulses to the piezoelectric actuators 231 is inhibited.

When the clock signal CLK, the gradation signals 0 and 1 and the latch signal LAT are received from the main controller 310, the drive controller 300 selects one of the control signals MN0-MN3 based on the gradation data indicated by the gradation signals 0 and 1. Specifically, by selecting one of the control signals MN0-MN3, the drive controller 300 selects one of ink ejection modes corresponding to the drive pulses for ejecting a large drop, the drive pulses for ejecting a middle drop, the drive pulses for ejecting a small drop, and the drive pulses for providing a fine oscillation (which will be described below). In the ink jet recording device of the present embodiment, it is possible to selectively carry out one of the ejection of large drops, the ejection of middle drops, the ejection of small drops, and the fine oscillation by selecting one of the ink ejection modes in this way.

Next, the drive waveform Pv in the ink jet recording device of the present embodiment will be described. The drive waveform Pv is stored in the memory part 321 of the drive signal generating circuit 320 in the present embodiment. In this regard, the memory part 321 does not have to be provided in the drive signal generating circuit 320. Alternatively, the memory part 321 may be provided in the main controller 310 or may be provided outside the drive controller 300.

The drive waveform Pv in the present embodiment may include multiple drive pulses within one print period. One of the ink drops with different amounts of ink can be selectively ejected at the same position on the recording medium by changing the selected drive pulses and the number of the drive pulses selected. The drive waveform Pv in the present embodiment may include a pulse for suppressing the residual oscillations by the Helmholtz period of the recording head 120.

Figure 5:
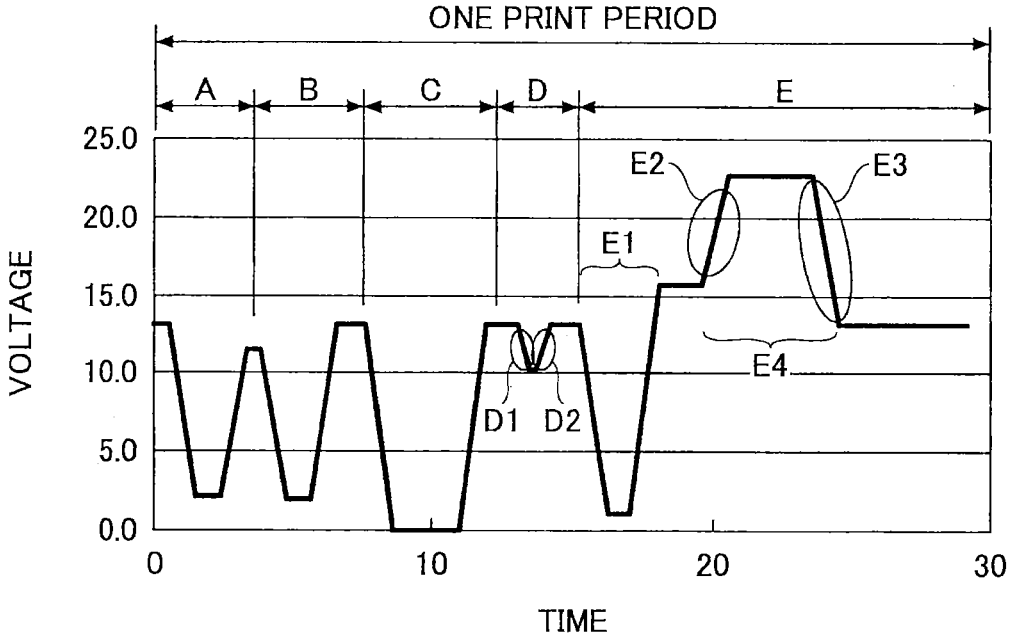
FIG. 5 is a diagram for explaining a drive waveform in the ink jet recording device of the present embodiment.

FIG. 5 is a diagram for explaining the drive waveform Pv in the ink jet recording device of the present embodiment. As shown in FIG. 5, drive pulses A, B, C, D and E are included in the drive waveform Pv in the present embodiment. The head driver circuit 330 selects the drive pulses to be supplied to the piezoelectric actuators 231 from among the drive pulses A-E included in the drive waveform Pv, based on the control signals MN0-MN3 from the main controller 310, and outputs the selected drive pulses to the piezoelectric actuators 231.

Among the drive pulses A-E included in the drive waveform Pv of FIG. 5, the drive pulses A and B are ink drop ejection pulses to eject a large drop. The drive pulse C is a pulse for suppressing the residual oscillations by the Helmholtz period of the recording head 120. The drive pulse C does not cause the ink drop ejection but suppresses the residual oscillations due to the ink drop ejection of the drive pulses A and B. The drive pulse C is used to stabilize the ink drop ejection due to the following ejection pulse. In the present embodiment, when ejecting multiple ink drops by using resonance, the ink drop ejection can be performed by using resonance without increasing the applied voltage. However, if the number of ejection pulses is increased, it is likely that the drawing of ink meniscus is excessive and unstable ink ejections, such as ink drop sway, takes place.

To prevent such phenomena, in the present embodiment, the drive pulse C as the non-ejection pulse for suppressing the residual oscillations is placed at the position following the tail end of the drive pulses A and B as the ejection pulses in the drive waveform Pv. Hence, the residual oscillations are reduced and the motion of ink meniscus is attenuated. Ink meniscus is a convex or concave curved surface which is formed by the ink in the ink ejection orifice 240 with interfacial tension.

Among the drive pulses A-E included in the drive waveform Pv of FIG. 5, the drive pulse D is a fine oscillation pulse which does not cause the ink drop ejection. In the present embodiment, the drive pulse D is supplied to the non-ejection orifice which is not caused to eject the ink drop. With a voltage falling portion D1 of the drive pulse D, the volume of the pressure chamber 241 is expanded so as not to eject the ink drop. After the state is retained for a predetermined time, the volume of the pressure chamber 241 is contracted with a voltage rising portion D2 of the drive pulse D.

In the present embodiment, the ink in the vicinity of the orifice is agitated by supplying the drive pulse D to the non-ejection orifice which is not caused to eject the ink drop. If the ink is agitated, the flow of the ink in the vicinity of the orifice can be smoothed, and the occurrence of undesired ink ejection by the supply of the following drive pulse due to the ink deterioration can be suppressed.

Among the drive pulses A-E included in the drive waveform Pv of FIG. 5, the drive pulse E is a final ejection pulse to eject a small drop. In addition, a function to shorten the length of satellites may be assigned to the drive pulse E. A conceivable method for shortening the length of satellites is to place a pulse portion having a voltage rising portion and a voltage falling portion (which will be called a "shortening pulse portion") at a position following the tail end of a single ejection pulse. However, if the satellite shortening pulse is placed at a position following the tail end of each of the respective ejection pulses in the drive waveform Pv, the whole length of the drive waveform Pv may be excessively large.

When multiple ink drops are ejected and the drops are combined into one drop during ejection, taking into consideration the length of satellites following the finally ejected ink drop is important. In the present embodiment, the satellite shortening function is assigned only to the drive pulse E which is the final ejection pulse in the drive waveform Pv, and the drive pulse E including the shortening pulse portion is placed at the position following the tail end of the drive pulse D. As shown in FIG. 5, the drive pulse E in the present embodiment includes an ejection pulse portion E1, and a shortening pulse portion E4 having a voltage rising portion E2 and a voltage falling portion E3.

In the present embodiment, the shortening pulse portion to shorten the length of satellites is included only in the final drive pulse E in the drive waveform Pv. Hence, the whole length of the drive waveform Pv in the present embodiment is smaller than that in the case where the shortening pulse portion is further placed at the position following the tail end of each of the drive pulses A and B in the drive waveform Pv.

Next, the cases in which the ink drop ejection of a large drop, a middle drop and a small drop is performed by the ink jet recording device 100 of the present embodiment will be described.

Figure 6:
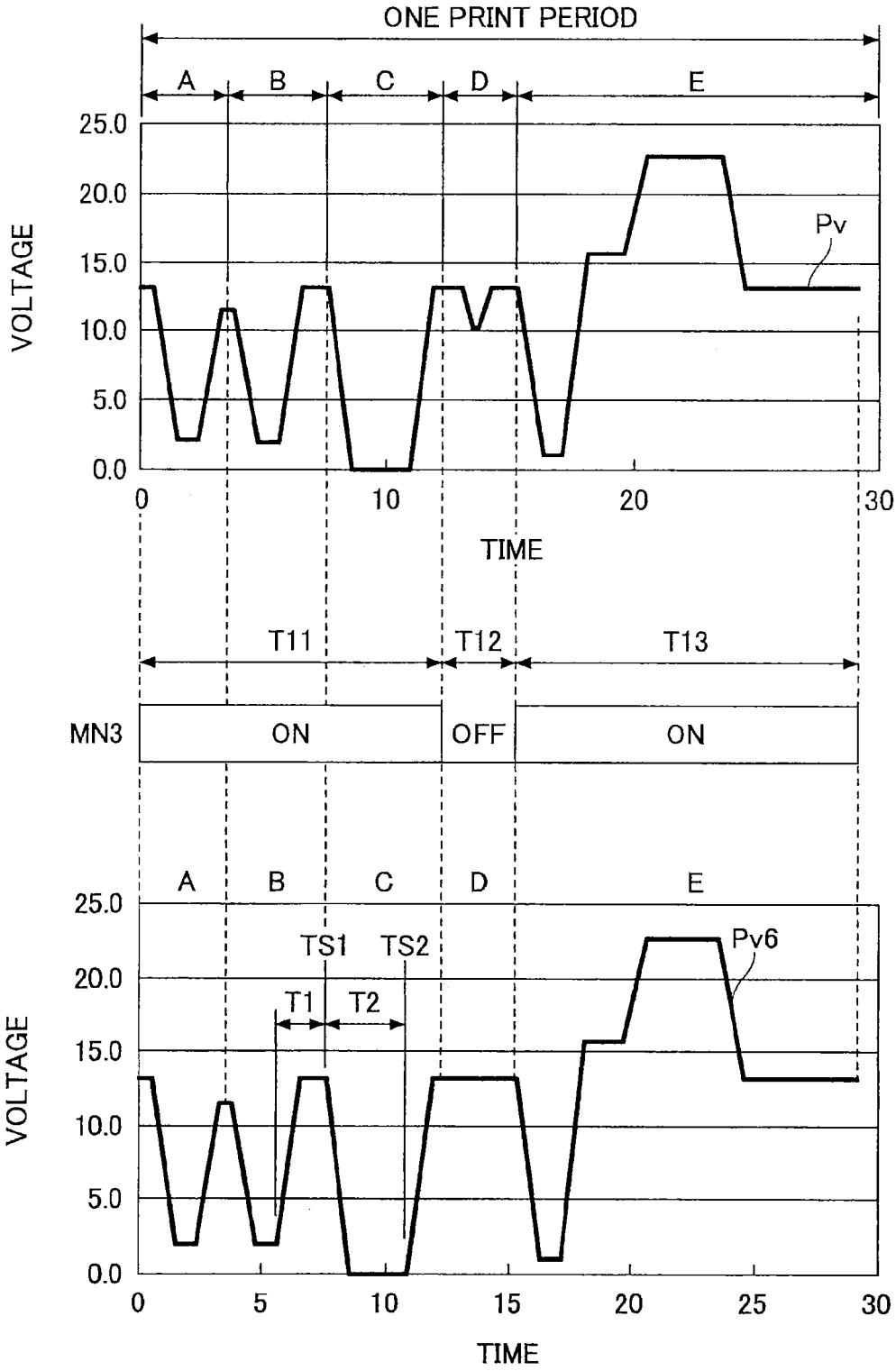
FIG. 6 is a diagram showing an example of the drive waveform in which an ink drop ejection mode of ejecting a large drop is selected.

FIG. 6 shows an example of the drive waveform in which the ink drop ejection mode of ejecting a large drop is selected.

In the ink jet recording device 100 of the present embodiment, a large drop can be ejected by using a drive waveform Pv6 shown in FIG. 6.

In the example of FIG. 6, four drive pulses A, B, C and E are selected from the drive waveform Pv and the drive waveform Pv6 is formed. Specifically, during a period T11 when the drive pulses A-C are output, the drive controller 300 supplies the drive waveform Pv6 to the piezoelectric actuator 231, and during a period T12 when the drive pulse D is output, the drive controller 300 does not supply the drive waveform Pv6 to the piezoelectric actuator 231. Furthermore, during a period T13 when the drive pulse E is output, the drive controller 300 supplies the drive waveform Pv6 to the piezoelectric actuator 231.

Namely, during the period T11 and the period T13, the drive controller 300 in the present embodiment turns on the switch connected to the piezoelectric actuator 231 corresponding to the ink ejection orifice 240 from which the large drop is to be ejected, and, during the period T12, the drive controller 300 turns off the switch, in accordance with the control signal MN3 for ejecting the large drop.

It is important that a solid image is formed on a recording medium when the ejection of large drops at all the orifices of the recording head is carried out at the maximum drive frequency, and the amount of ink that forms a large drop when the recording head 120 is operated at the maximum drive frequency has been measured with respect to the ink jet recording device of the present embodiment. In the case of the ink jet recording device of the present embodiment, 9 pl (picoliters) has been measured as the amount of ink that forms a large drop.

Next, the position of the drive pulse C in the drive waveform Pv will be described. As shown in FIG. 6, a period T1 from a start of voltage rising of the drive pulse B to a start of voltage falling of the drive pulse C in the drive waveform Pv in the present embodiment is determined by Helmholtz period Tc×n (where n is an integer). This Helmholtz period Tc is specific to the recording head 120. Moreover, a period T2 from a start of voltage falling of the drive pulse C to a start of voltage rising of the drive pulse C in the drive waveform Pv is determined by Helmholtz period Tc×n. "n" may be an integer, but, if the whole length of the drive waveform Pv is taken into consideration, it is preferred that "n" is equal to 1.

In the present embodiment, the period T1 and the period T2 are determined by Helmholtz period Tc×n, and the drive pulse C in the drive waveform Pv is a non-ejection pulse.

In the recording head 120 of the present embodiment, when the voltage supplied to the piezoelectric actuator 231 is lowered, the liquid level of ink is drawn to the inside of the ink ejection orifice 240, and when the voltage supplied to the piezoelectric actuator 231 is increased, the liquid level of ink is pushed out from the ink ejection orifice 240 to eject the ink drop.

In the following, it is assumed that the period T1 and the period T2 are equal to Helmholtz period Tc, and the example of FIG. 6 will be described.

As shown in FIG. 6, at a timing TS1 which corresponds to the end of the period T1, the voltage falling of the drive pulse C is started, and the liquid level of ink is drawn to the inside of the ink ejection orifice 240 at a timing following one period from the timing TS1. Hence, the oscillation reducing effect can be provided by the drive pulse C.

The ink speed in the outward direction is the maximum at the timing TS1 which corresponds to the end of the period T1, and, if the liquid level of ink is drawn to the inside of the ink ejection orifice 240 at the timing TS1 (the inward force is given), the oscillation of the liquid level can be effectively suppressed.

At the timing TS1, the liquid level of ink is drawn to the inside of the ink ejection orifice 240 and the oscillation of the liquid level is started. At a timing TS2, the displacement of the oscillation of the liquid level in the inward direction is the maximum and the voltage rising of the drive pulse C is started. Hence, starting from the timing TS2, the force to push the liquid level of ink outside is exerted. In the present embodiment, the drive pulse C is placed in the drive waveform at the position following the end of the drive pulse B, and the force to draw the liquid level of ink inside and the force to push the liquid level of ink outside cancel each other by the drive pulse C, so that the ink drop ejection is not performed.

Figure 7:
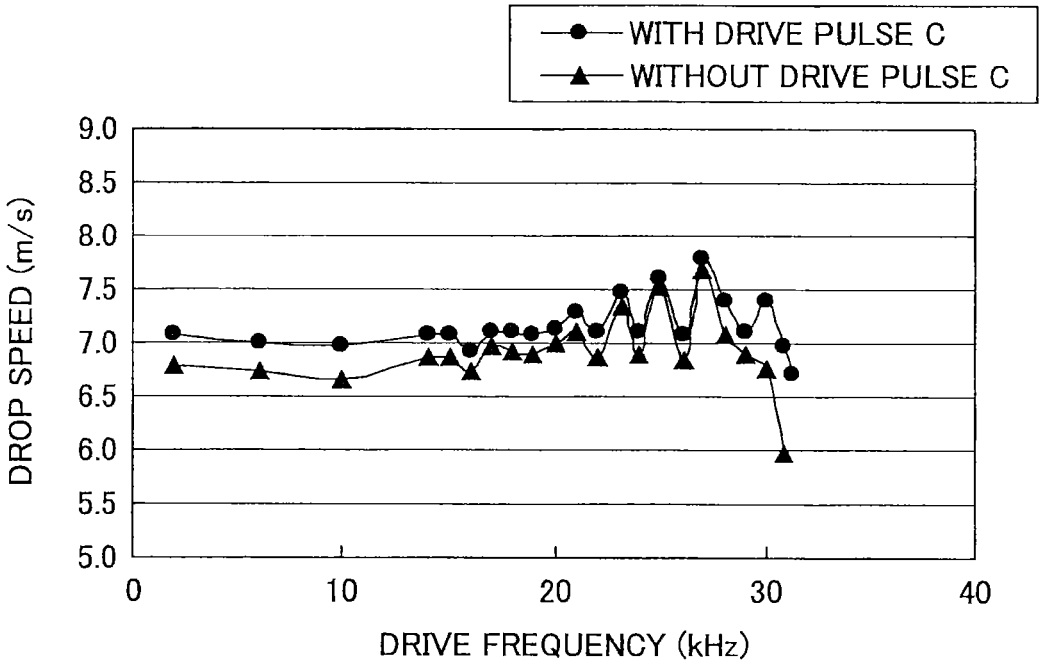
FIG. 7 is a diagram for explaining the relationship between the drive frequency and the drop speed in the large drop ejection mode.

FIG. 7 is a diagram for explaining the relationship between the drive frequency and the drop speed when the ink drop ejection mode of ejecting a large drop is selected. In FIG. 7, measurement results in which the drive pulse C (which is a non-ejection pulse) is included in the drive waveform, and measurement results in which the drive pulse C is not included in the drive waveform are illustrated. As shown in FIG. 7, fluctuations of the drop speed at high frequencies exist, but the fluctuations of the drop speed with the drive pulse C included are smaller than those without the drive pulse C. It has been observed that the stability of ink drop ejection is improved as the voltage is increased to increase the drop speed with the drive pulse C included.

Figure 8:
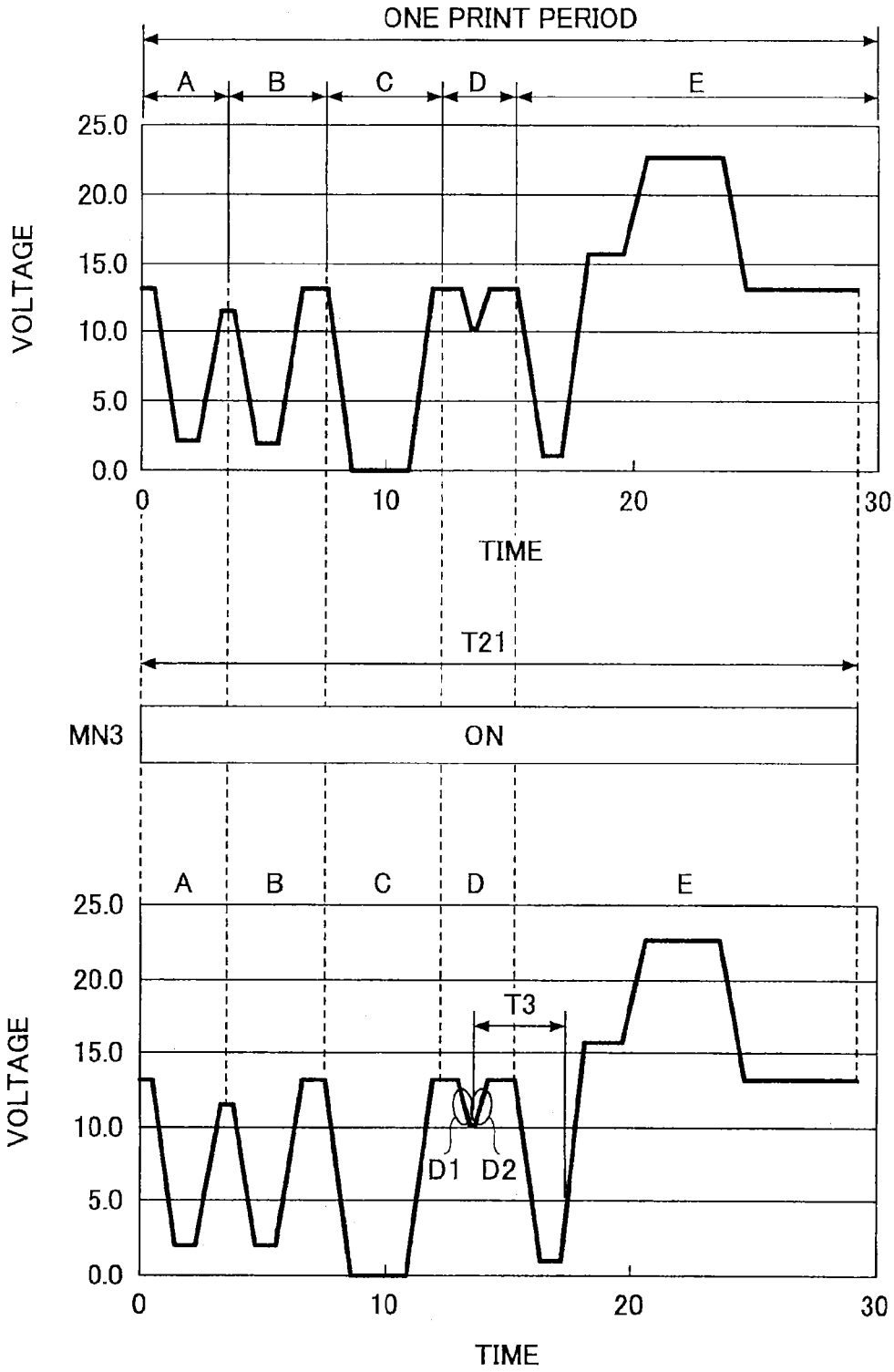
FIG. 8 is a diagram showing another example of the drive waveform in which the ink drop ejection mode of ejecting a large drop is selected.

FIG. 8 shows another example of the drive waveform in which the ink drop ejection mode of ejecting a large drop is selected. In the example of FIG. 8, five drive pulses A-E which are all the drive pulses included in the drive waveform Pv are selected from the drive waveform Pv. Specifically, during a period T21 (which is equivalent to one print period), the drive controller 300 turns on the switch connected to the piezoelectric actuator 231 corresponding to the ink ejection orifice 240 from which the large drop is to be ejected, in accordance with the control signal MN3 for ejecting the large drop.

In the previous example of FIG. 6, the drive pulse C which is a non-ejection pulse is placed between the drive pulses B and E which are ejection pulses and the action of combining the drop ejected by the preceding drive pulse B and the drop ejected by the final drive pulse E delays slightly.

On the other hand, in the example of FIG. 8, the drive pulse D which is a fine oscillation pulse is further included in the drive waveform, and a period T3 from a start of voltage rising of the drive pulse D to a start of voltage rising of the final drive pulse E is determined by Helmholtz period Tc×n (where n is an integer).

In the example of FIG. 8, the drop speed by the final drive pulse can be increased slightly and the action of combining the drop ejected by the preceding drive pulse and the drop ejected by the final drive pulse E can be performed suitably.

Figure 9:
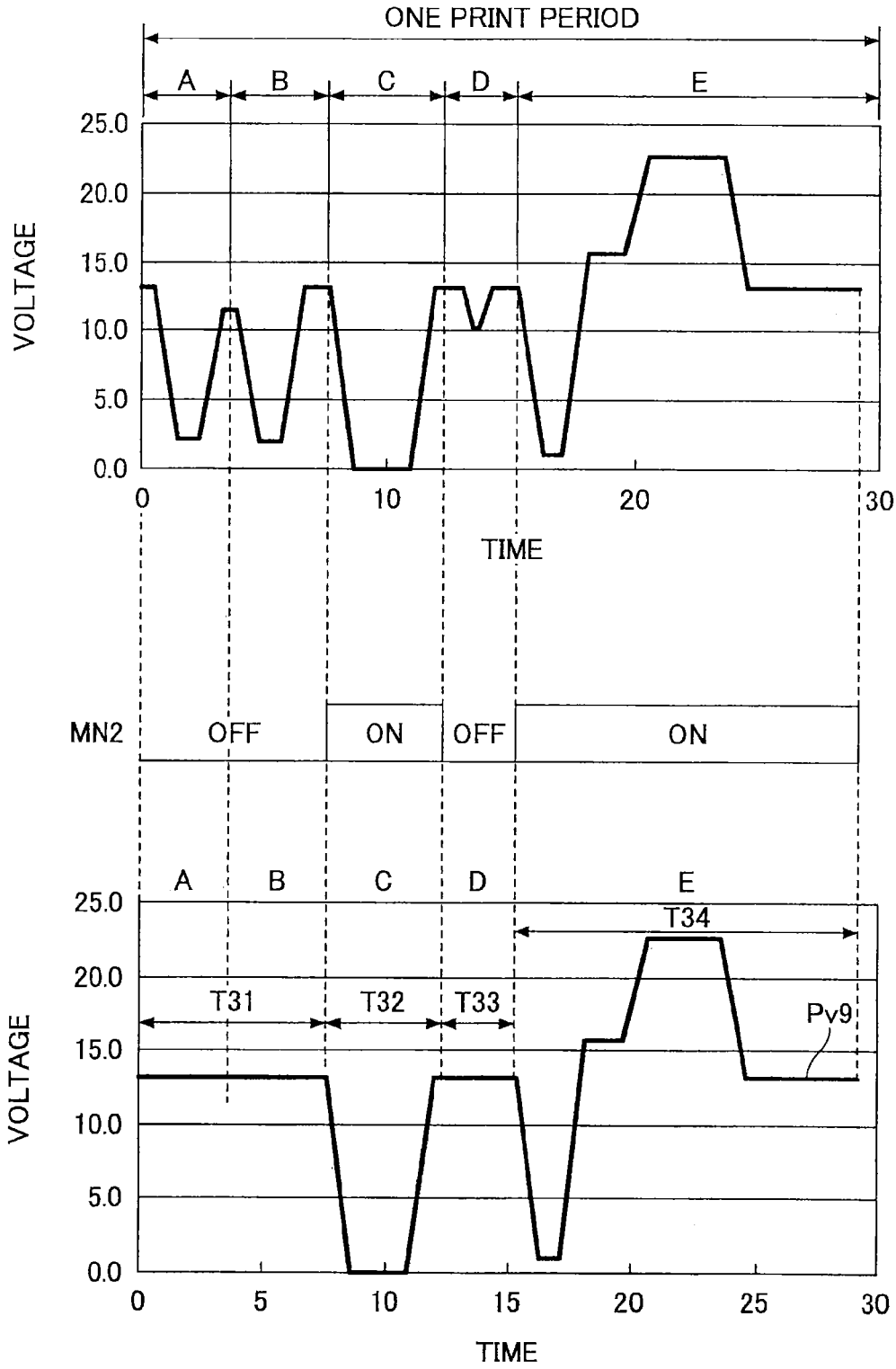
FIG. 9 is a diagram showing an example of the drive waveform in which an ink drop ejection mode of ejecting a middle drop is selected.

FIG. 9 shows an example of the drive waveform in which the ink drop ejection mode of ejecting a middle drop is selected. In the example of FIG. 9, drive pulses C and E are selected from the drive waveform Pv and a drive waveform Pv9 is formed. Specifically, during each of periods T32 and T34, the drive controller 300 turns on the switch connected to the piezoelectric actuator 231 corresponding to the ink ejection orifice 240 from which the middle drop is to be ejected, and during each of periods T31 and T33, the drive controller 300 turns off the switch, in accordance with the control signal MN2 for ejecting the middle drop.

In the case of the drive waveform Pv9 of FIG. 9, about 4 pl has been measured as the amount of ink that forms the middle drop when the recording head 120 is operated at the maximum drive frequency. If the drive frequency is increased to a higher frequency, the amount of the ink drop ejected is increased accordingly. If the amount of ink as a small drop ejected by one ejection pulse when operated at a low drive frequency is 2 pl, the amount of ink as the small drop ejected by two ejection pulses when operated at a high drive frequency will exceed 4 pl. To avoid this, the non-ejection pulse C for suppressing the residual oscillations as in the large drop ejection is used in the drive waveform Pv9. The residual oscillations are reduced, the position of ink meniscus is slightly raised and the ink drop ejection is performed in a manner similar to a fire-before-push mode of operation. Hence, the amount of ink ejected as the middle drop which does not exceed 4 pl can be obtained.

Figure 10:
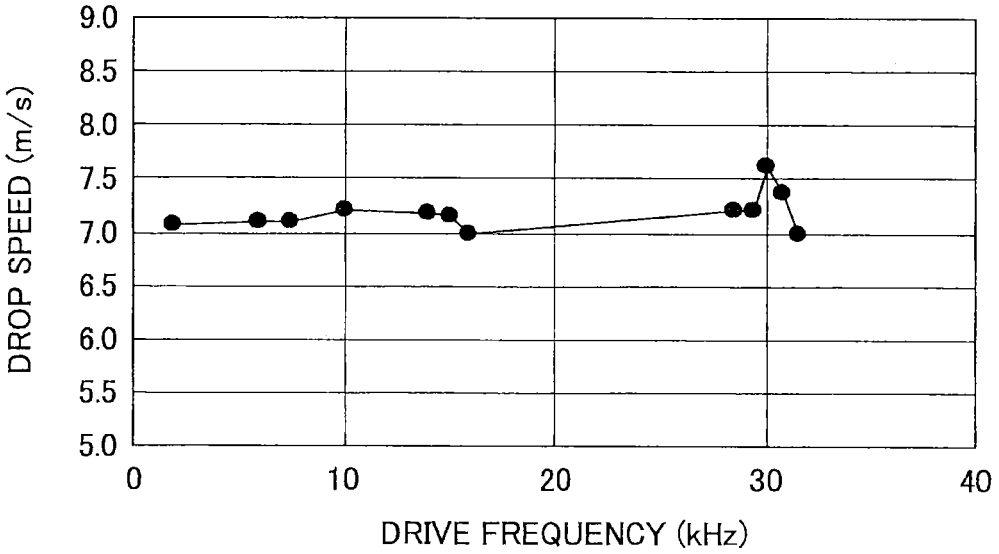
FIG. 10 is a diagram for explaining the relationship between the drive frequency and the drop speed in the middle drop ejection mode.

FIG. 10 is a diagram for explaining the relationship between the drive frequency and the drop speed in the middle drop ejection mode. As shown in FIG. 10, when the drive frequency is increased to high frequencies, the drop speed is slightly fluctuated. When the drive frequency is at low frequencies, the drop speed is stabilized at about 7 m/s. It has been observed that the drop speed at the low frequencies is almost the same for the small drop ejection mode, the middle drop ejection mode and the large drop ejection mode.

Figure 11:
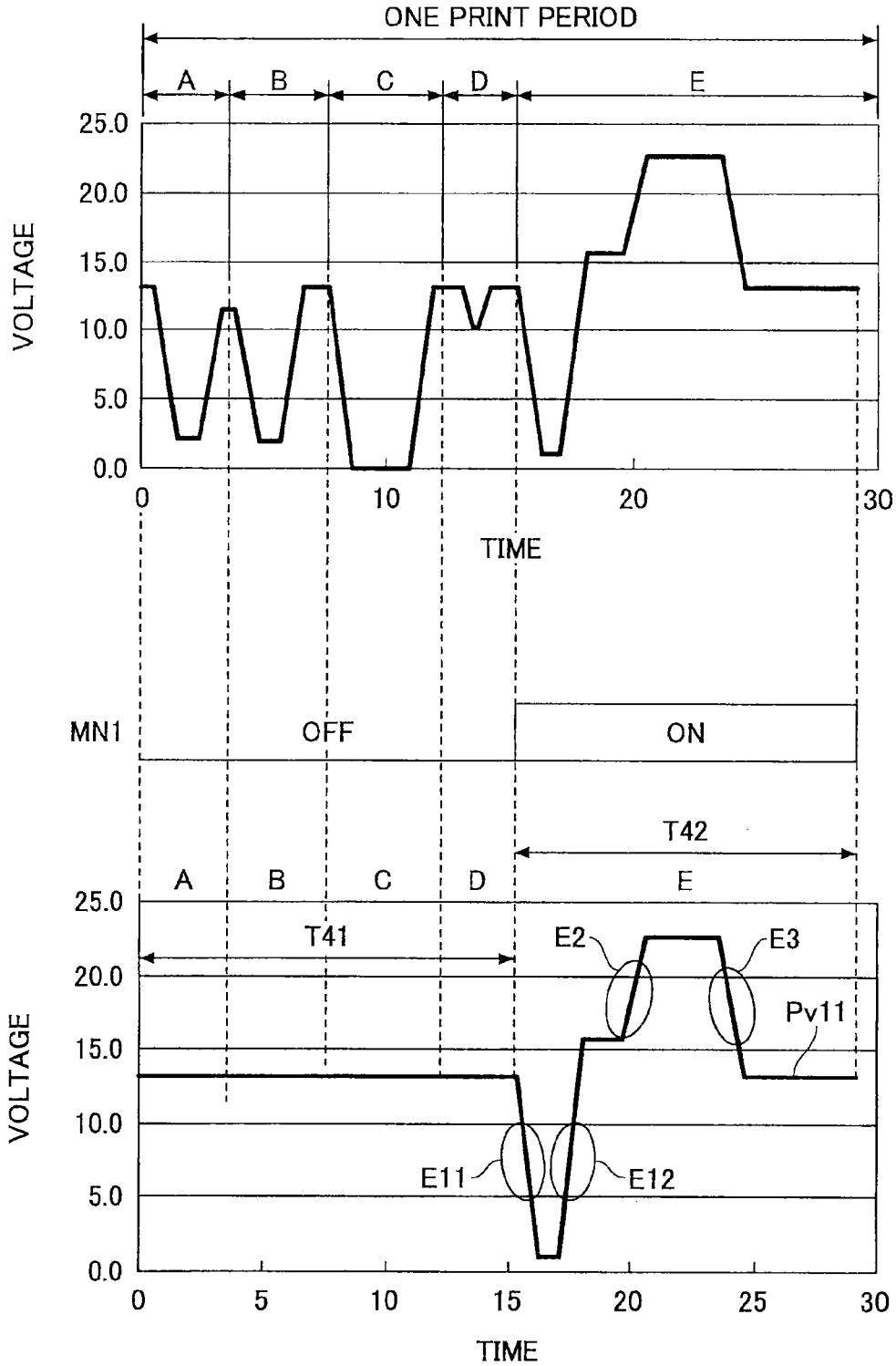
FIG. 11 is a diagram showing an example of the drive waveform in which an ink drop ejection mode case of ejecting a small drop is selected.

FIG. 11 shows an example of the drive waveform in which the ink drop ejection mode of ejecting a small drop is selected. In the example of FIG. 11, a drive pulse E is selected from the drive waveform Pv and a drive waveform Pv11 is formed.

Specifically, during a period T42, the drive controller 300 turns on the switch connected to the piezoelectric actuator 231 corresponding to the ink ejection orifice 240 from which the small drop is to be ejected, and, during a period T41, the drive controller 300 turns off the switch, in accordance with the control signal MN1 for ejecting the small drop.

In the case of the drive waveform Pv11 of FIG. 11, the voltage is adjusted so that, when 200 μsec. has elapsed from the reference time of 0 μsec., the ink drop reaches the recording medium which is located at a position of 1.4 mm away from the ink ejection orifice 240. Specifically, with a voltage falling portion E11 of the drive pulse E in the drive waveform Pv11 of FIG. 11, the liquid level of ink is drawn to the inside of the ink ejection orifice 240, and with a voltage rising portion E12 of the drive pulse E, the ink in the pressure chamber 241 is pressurized and the ink drop is ejected from the ink ejection orifice 240. A fire-before-draw mode of operation is used.

The drive waveform Pv11 is arranged so that the voltage is temporarily held after the ink drop ejection and a voltage rising portion E2 of the drive pulse E is present again. This voltage rising portion E2 is provided in order to shorten the length of satellites following the ejection of the ink drop.

In the present embodiment, with the use of the first-step voltage rising portion E12 and the second-step voltage rising portion E2, after the ink drop is ejected, a depressed part in the ink is formed immediately from the state of the ink drop still connected to the orifice. Hence, the ink liquid separation promptly takes place by surface tension to form the ink drop and the length of satellites can be shortened. The amount of ink ejected as the small drop measured with the example of FIG. 11 is about 2 pl.

Figure 12:
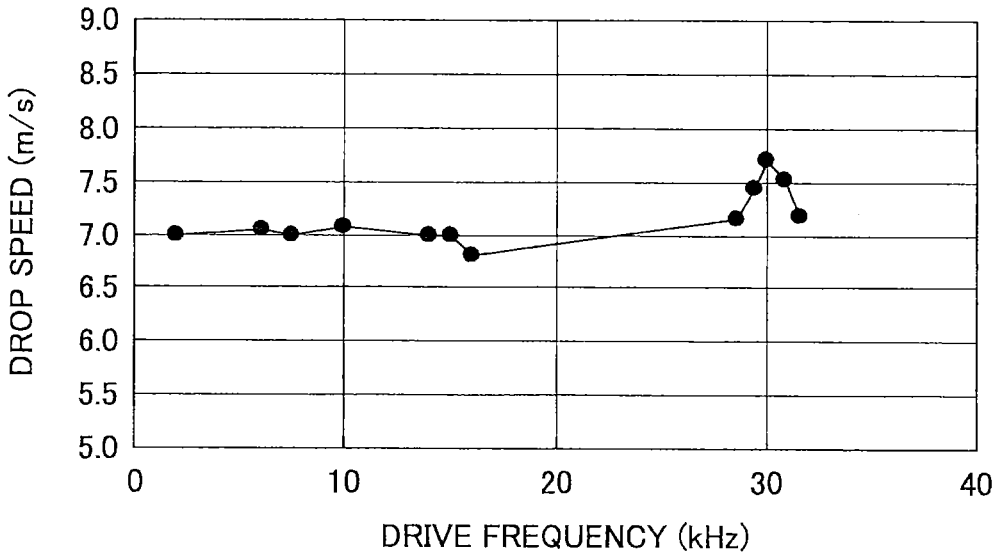
FIG. 12 is a diagram for explaining the relationship between the drive frequency and the drop speed in the small drop ejection mode.

FIG. 12 is a diagram for explaining the relationship between the drive frequency and the drop speed in the small drop ejection mode. As shown in FIG. 12, when the drive frequency is increased to high frequencies, the drop speed is slightly fluctuated due to the influence of the residual oscillations by the preceding ink drop. When the drive frequency is at low frequencies, the drop speed is stabilized at about 7 m/s.

Figure 13:
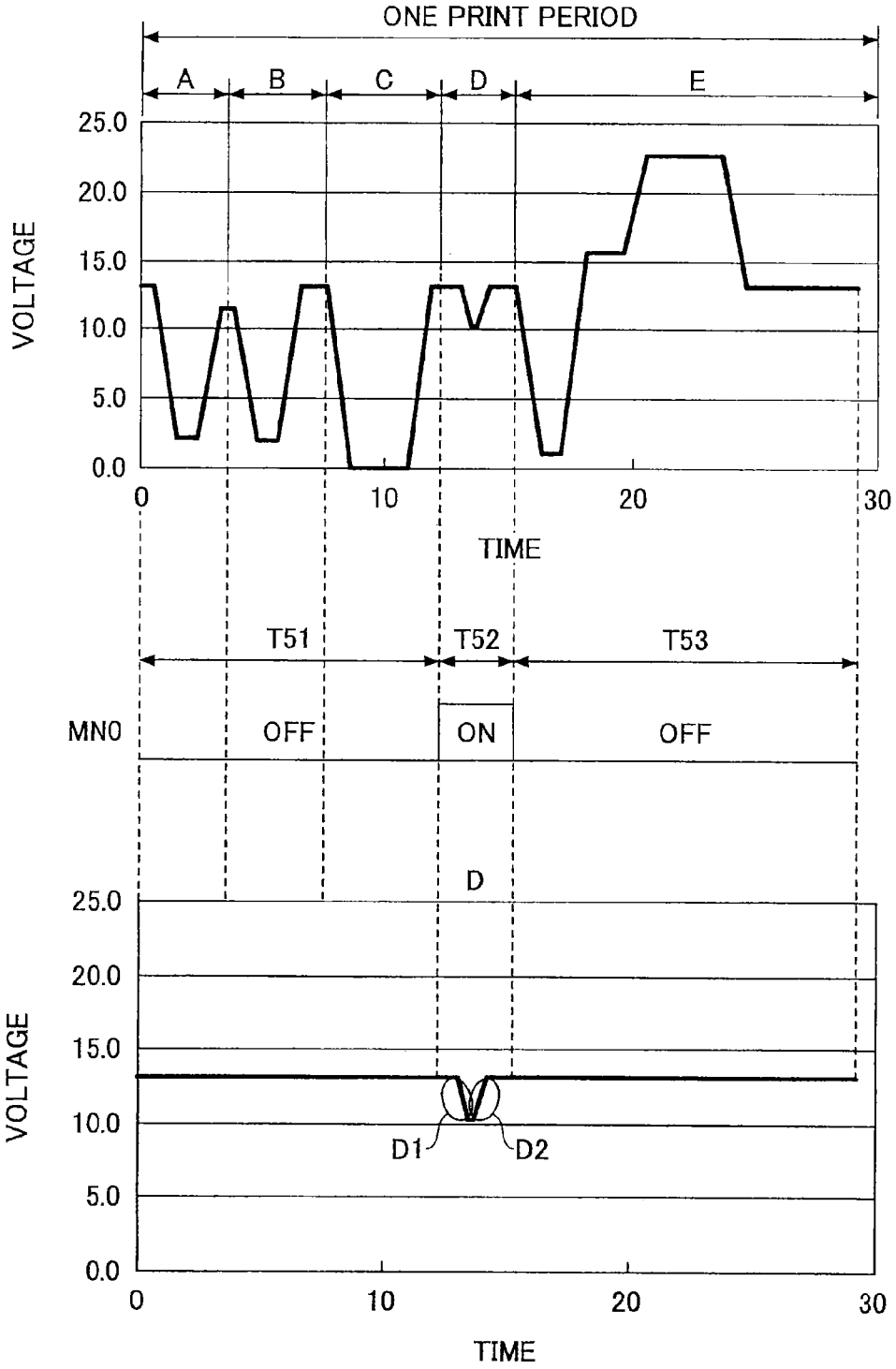
FIG. 13 is a diagram showing an example of the drive waveform in which a fine oscillation pulse is selected.

FIG. 13 is a diagram showing an example of the drive waveform in which a fine oscillation pulse is selected. In the example of FIG. 13, a drive pulse D is selected from the drive waveform Pv.

Specifically, during a period T52, the drive controller 300 turns on the switch connected to the piezoelectric actuator 231 to which the fine oscillation pulse is supplied, and during each of periods T51 and T53, the drive controller 300 turns off the switch, in accordance with the control signal MN0 for the fine oscillation.

In the present embodiment, the drive pulse D in the drive waveform of FIG. 13 is supplied and, with a voltage falling portion D1 of the drive pulse D, the volume of ink in the pressure chamber 241 is expanded so as not to eject an ink drop. After the state is held for a predetermined time, with a voltage rising portion D2 of the drive pulse D, the volume of ink in the pressure chamber 241 is contracted. Upon supplying a subsequent ejection pulse, the ink drop is normally ejected.

As described in the foregoing, in the ink jet recording device of the present embodiment, the drive waveform Pv is stored in the memory part 321 and the drive pulse C as the non-ejection pulse for suppressing the residual oscillations is placed at the position following the tail end of the drive pulses A and B as the ejection pulses in the drive waveform Pv. Because the ink jet recording device of the present embodiment uses the drive waveform Pv, separately preparing a dedicated drive waveform for reducing the residual oscillations is unnecessary. Moreover, the influence of the residual oscillations following the ink drop ejection can be reduced and the ink drop ejection can be performed in a stable manner.

The ink jet recording device of the present invention is applicable to a liquid drop ejecting device which ejects drops of special liquids, such as color material liquids used for formation of color filters of a liquid crystal display, electrode material liquids used for formation of electrode films of an organic electroluminescence (EL) display, etc.

As described in the foregoing, according to the ink jet recording device of the present invention, it is possible to maintain the stability of ink drop ejection without increasing the occurrence of misaligned ejection.

The ink jet printing device of the present invention is not limited to the specifically disclosed embodiments, and variations and modifications may be made without departing from the scope of the present invention.

The present application is based upon and claims the benefit of priority of Japanese Patent Application No. 2012-159322, filed on Jul. 18, 2012, the contents of which are incorporated herein by reference in their entirety.

What is claimed is:

1. An ink jet recording device comprising:

an ink jet recording head including a pressure chamber that communicates with an ink ejection orifice, and a piezoelectric actuator that changes a pressure of ink in the pressure chamber;

a drive signal generating unit that generates a drive waveform having multiple drive pulses; and a pulse supplying unit that selects one or more of the drive pulses from the drive waveform depending on a size of an ink drop to be ejected from the ink ejection orifice and supplies the selected drive pulses to the piezoelectric actuator, wherein:

the multiple drive pulses in the drive waveform comprise a plurality of ejection pulses to eject the ink drop from the ink ejection orifice and a non-ejection pulse to suppress residual oscillations of the ink following the ejection pulses, the pulse supplying unit is configured to select one or more of the plurality of ejection pulses and the non-ejection pulse from the drive waveform when an ink drop having a maximum size is to be ejected from the ink ejection orifice, the multiple drive pulses in the drive waveform comprise a final ejection pulse located at a tail-end position of the drive waveform to eject the ink drop, and the pulse supplying unit is configured to select the final ejection pulse from drive waveform when the ink drop having the maximum size is to be ejected, and the multiple drive pulses in the drive waveform comprise a fine oscillation pulse located between the non-ejection pulse and the final ejection pulse to pressurize the ink in the pressure chamber without ejecting the ink drop, and the pulse supplying unit is configured to select the fine oscillation pulse from the drive waveform when the ink drop having the maximum size is to be ejected.

2. The ink jet recording device according to claim 1, wherein a period from a start of voltage rising of the fine oscillation pulse to a start of voltage rising of the final ejection pulse in the drive waveform is determined by an integer multiple of a Helmholtz period of the ink jet recording head.

3. A method of driving an ink jet recording head in an ink jet recording device, the ink jet recording head including a pressure chamber communicating with an ink ejection orifice and a piezoelectric actuator pressurizing ink in the pressure chamber, the method comprising:

generating a drive waveform having multiple drive pulses;

selecting one or more of the drive pulses from the drive waveform depending on a size of an ink drop to be ejected from the ink ejection orifice; and supplying the selected drive pulses to the piezoelectric actuator, wherein the multiple drive pulses in the drive waveform comprise a plurality of ejection pulses to eject the ink drop and a non-ejection pulse to suppress residual oscillations of the ink following the ejection pulses, and the selecting includes selecting one or more of the plurality of ejection pulses and the non-ejection pulse from the drive waveform when an ink drop having a maximum size is to be ejected from the ink ejection orifice, the multiple drive pulses in the drive waveform comprise a final ejection pulse located at a tail-end position of the drive waveform to eject the ink drop, and the supplying selects the final ejection pulse from drive waveform when the ink drop having the maximum size is to be ejected, and the multiple drive pulses in the drive waveform comprise a fine oscillation pulse located between the non-ejection pulse and the final ejection pulse to pressurize the ink in the pressure chamber without ejecting the ink drop, and the supplying selects the fine oscillation pulse from the drive waveform when the ink drop having the maximum size is to be ejected.

* * * * *